US005209100A

United States Patent [19]

Dischler

[11] Patent Number: 5,209,100

[45] Date of Patent: May 11, 1993

[54] COMPRESSION TOOL

[76] Inventor: Helmut Dischler, Droste-Hülshoff-Str. 9, D-4040 Neuss 1, Fed. Rep. of Germany

[21] Appl. No.: 895,449

[22] Filed: Jun. 8, 1992

Related U.S. Application Data

[63] Continuation of Ser. No. 680,420, Apr. 4, 1991, abandoned.

[30] Foreign Application Priority Data

Apr. 12, 1990 [DE] Fed. Rep. of Germany ..... 4011822

[51] Int. Cl.[5] ..... B21D 39/04

[52] U.S. Cl. ..... 72/410; 72/402; 29/237

[58] Field of Search ..... 72/410, 409, 452, 402; 29/237

[56] References Cited

U.S. PATENT DOCUMENTS

| | | | |
|---|---|---|---|
| 2,381,748 | 8/1945 | Howe | 29/148 |
| 3,154,981 | 11/1964 | McDurmont | 72/402 |
| 3,706,219 | 12/1972 | Hoffman | 72/402 |
| 3,744,114 | 7/1973 | Melsom | 29/237 |
| 3,792,603 | 2/1974 | Orain | 72/410 |
| 4,276,765 | 7/1981 | Yoneda | 72/402 |

FOREIGN PATENT DOCUMENTS

| | | |
|---|---|---|
| 1187870 | 10/1965 | Fed. Rep. of Germany . |
| 2458172 | 1/1976 | Fed. Rep. of Germany . |
| 2136782 | 12/1982 | Fed. Rep. of Germany . |
| 3423283 | 1/1986 | Fed. Rep. of Germany . |
| 3513129 | 10/1986 | Fed. Rep. of Germany . |
| 1426844 | 12/1965 | France . |
| 2086319 | 12/1971 | France . |
| 60-141456 | 7/1985 | Japan . |

*Primary Examiner*—Daniel C. Crane
*Attorney, Agent, or Firm*—Joseph W. Berenato, III

[57] ABSTRACT

A compression tool for joining tubular workpieces is provided with two or more arcuate compression jaws displaceable relative to each other in such a manner that the jaws can be opened for placement o a tubular segment of the workpiece. The compression tool (121) comprises compression jaw supports (132, 133) pivotally mounted on pivot bolts (134, 135). Two compression jaws (142–145) of each jaw support are guided along guide surfaces (138–141) which subtend an angle symmetrical to the center of the compression space when the compression jaws are in a closed state. The compression jaws are biased by a spring (146–149) along the guide surfaces (138–141) toward terminal end stops (150–153). Movement of the jaw supports about the pivot bolts (126, 127) permits opening and closing of the compression jaws.

20 Claims, 2 Drawing Sheets

COMPRESSION TOOL

This is a continuation of co-pending application Ser. No. 07/680,420, filed on Apr. 4, 1991, now abandoned.

The invention concerns in particular a compression tool for connecting tubular workpieces, comprising more than two arcuate press jaws mutually displaceable in such a way that they can be opened to be placed upon the tube segment and that the complement each other near the end of compression into a closed compression space, further comprising at least one drive to displace the compression jaws in the direction of compression.

Plastically deforming, metal, and preferably steel coupling sleeves are used to connect pipe ends. Their inside diameter is larger by such an extent than the outside diameter of the pipes to be joined that upon radial compression they remain deformed until they abut the outside surface of the pipe ends. As disclosed in the German patent 1,187,870 such coupling sleeves may additionally comprise an inside annular groove near their ends to receive an elastic sealing ring.

The radial compression is carried out using compression tools such as are known for instance from the German patent 21 36 782. This compression tool comprises two clamping jaws each with two arms, at least one jaw being pivotably supported on the tool. The clamping jaws comprise compression surfaces of equal radius and forming arc-of-circle segments enclosing a compression space. Instead of being arcs of circle, the compression surfaces also may be contoured for instance to form a polygonal or oval compression space.

The arms of the clamping jaws away from the compression space may be spread apart against a spring force so that the clamping jaws are mutually displaced in the region of the compression space. This expansion takes place by means of adjacent and abutting compression rollers which are jointly moved by a drive in the form of an operational cylinder between the arms and which thereby pivot the clamping jaws.

A further development of this compression tool is described in the German Offenlegungsschrift 34 23 283. In this compression tool two compression jaws are present, each pivotably supported by a drive lever that in turn is pivotably guided by the compression tool. The drive levers comprise opposite arms which can be spread apart by actuator-driven pressure-rollers moving into the gap and thereby displacing the compression jaws relative to each other. These compression jaws furthermore are so guided inside slide means that upon the pivoting motion of the drive levers into the open directions, they will be pivoted upward about their hinges to the drive levers, whereby a further tong-like aperture is created between the end faces of the compression jaws to facilitate receiving the pipe ends to be joined or a coupling sleeve.

When the drive levers are pivoted in the reverse direction, the clamping jaws again are pivoted in such manner that the mid-perpendiculars approximately coincide at their arcs and upon further pivoting of the drive levers the clamping jaws are mutually displaced while remaining parallel. During the compression the clamping jaws are further displaced relative to each other until at the end of compression they enclose a circular area and thereby they shall have correspondingly deformed the pipe ends or the coupling sleeve with reduction in diameter.

This compression tool has been found practical provided that the reduction in diameter, i.e. the squeeze depth, not be unduly large. As regards larger squeeze depths—which are required when the pipe joints must withstand substantial inner pressures—more than two compression jaws must be provided to prevent that the end faces of the clamping jaws form between them projecting beads that might prevent complete closing by the clamping jaws. Such compression tools illustratively are known from the German Offenlegungsschriften 21,182; 35 13 129 and Germ Auslegeschriften 25 11 942 and 19 07 956. All the compression tools described therein share in common that all the compression jaws are movable and guided in the radial direction. This entails complex guide means and drive systems, which renders the compression tools heavy and hence hard to handle and furthermore makes them expensive.

Accordingly it is the object of the invention to so design a compression tool of the initially cited kind that it shall be as simple as possible and therefore easily handled, as well as economical in spite of the presence of more than two compression jaws.

This problem is solved by the invention in that the compression tool comprises at least one, preferably two compression-jaw support(s) wherein each time at least two compression jaws are guided in such a way that their displacement paths each time subtend an angle symmetrically located to the center of the compression space for the closed condition of the compression tool and opening relative to this center point. Appropriately the compression clamps are so displaced relative to one another that their adjacent, opposite end faces are equidistant at the beginning of compression.

The compression tool of the invention is characterized by a simple design because at least two compression jaws are displaceably guided inside the compression-jaws support(s) and only the compression-jaw support(s) are linked to the drive means. Therefore the need of one drive for each compression jaw is eliminated. Accordingly this compression tool is easily handled and economical to manufacture.

The invention provides that the compression jaws evince equally long arcs of circle so that the gap between the end faces of the clamping jaws are equi-distant over the circumference.

Appropriately two mutually oppositely directed compression-jaw supports each with two displaceable compression jaws are provided. However it is entirely feasible also to provide three or even more compression-jaw supports, without the need for each such support being driven. Another configuration of the compression jaws is achieved in that a stationary compression jaw is mounted on the compression-jaw support(s) between the particular movable compression jaws.

Preferably the movable compression jaws are spring-loaded toward a stop in the direction of aperture of the angle of the displacement paths. Appropriately straight, V-shaped guide means are present for the compression jaws displaceably held in the compression-jaw supports.

The invention is illustrated by embodiments shown in the drawing.

Figure 1:
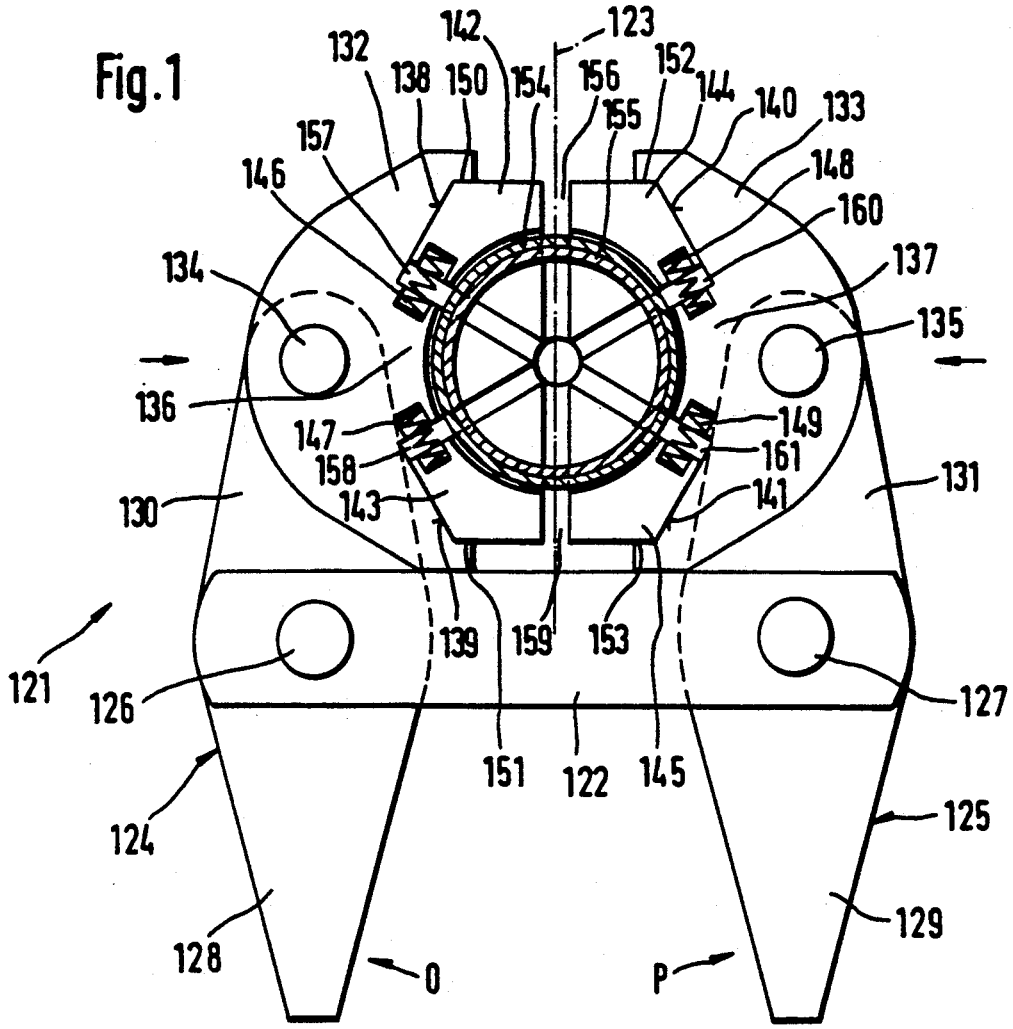
FIG. 1 is a compression tool in the open position.
Figure 2:
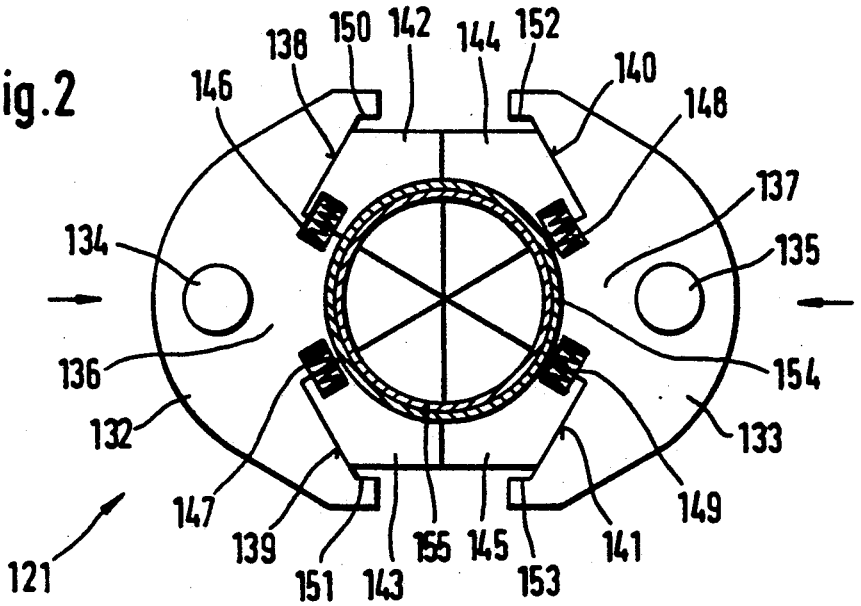
FIG. 2 is part of the compression tool of FIG. 1 in the closed position.

FIGS. 1 and 2 show a first embodiment of the invention. The compression tool 121 shown in these Figures evinces similarities with that of the German Offenlegungsschrift 34 23 283. It comprises a frame part 122 which, in manner not shown herein in further detail, is rigidly connected to a drive and assumes the function of tool housing.

Two drive levers 124, 125 mirror-symmetrical to the longitudinal axis 123 are pivotably supported at the frame part 122 on pivot bolts 126, 127 perpendicular to the plane of the drawing. The down-pointing arms 128, 129 of the drive levers 124, 125 are spread apart in order to pivot in the directions of arrows O, P against the force of a spring, not further shown herein, pulling together the lower arms 128, 129. A pair of compression rollers is used to spread apart the lower arms 128, 129 as describe din principle in the German Offenlegungsschrift 34 23 283.

Compression-jaws supports 132, 133 link in mirror-symmetrical manner with the arms 130, 131 extending upward from the pivot bolts 126, 127, said supports being linked by means of pivot bolts 134, 135 perpendicular to the plane of the drawing. These compression-jaws supports 132, 133 are centrally shaped into compression jaws 136, 137. In each case and to the side, the compression-jaws supports 132, 133 comprise plane guide surfaces 138, 139, 140, 141 extending in V-manner, the V angles opening toward one another. Further compression jaws 142, 143, 144, 145 rest against these guide surfaces 138, 139, 140, 141. The compression jaws 142, 143, 144, 145 each are forced outward by means of compression springs 146, 147, 148, 149 resting against the compression-jaws supports 132, 133 and, prior to compression, rest against stops 150, 151, 152, 153. Moreover, the guide surfaces 138, 139, 140, 141 and the surfaces of the compression jaws 142, 143, 144, 145 resting against them are designed in such a way that the latter cannot drop out when the compression tool 121 is open.

When this compression tool 121 is used, first the lower arms 128, 129 of the drive levers 124, 125 are manually pressed together, that is opposite the arrows O, P. As a result the upper arms 130, 131 open in tong-like manner and make space accessible, whereby the compression tool 121 can be slipped over a coupling sleeve 154 sitting on one pipe end 155 in a direction transverse to the said sleeve's longitudinal direction. The compression-jaws supports 132, 133—in a manner not shown herein—may be so guided using slide means such as are described for the compression tool of German Offenlegungsschrift 34 23 283 that first they move apart while remaining axially parallel and then upon a pivoting motion open upward.

After the compression tool has been slipped over the coupling sleeve 154, the compression-jaws supports 132, 133 are closed by spreading apart the lower arms 128, 129 using the drive which is omitted herefrom. The compression jaws 136, 137, 142, 143, 144, 145 then come to rest against the outer surface of the coupling sleeve 154, but only by their particular outer transverse edges. The stops 150, 151, 152, 153 are mounted in such a way that essentially equal gaps 156, 157, 158, 159, 160, 161 remain between the six compression jaws 136, 137, 142, 143, 144, 145.

By further compression by the drive, the lower arms 128, 129 of the drive levers 124, 125 are spread apart additionally. As a result, compression-jaws supports 132, 133 further move toward each other and essentially in axially parallel manner. At the same time the upper and lower compression jaws 142, 143, 144, 145 move in such a way on their guide tracks 138, 139, 140, 141 against the effects of the compression springs 146, 147, 148, 149 that the gaps 156, 157, 158, 159, 160 remain essentially equal during the entire compression procedure. Lastly, the end faces of compression jaws 136, 137, 142, 143, 144, 145 will be mutually touching at the termination of compression. This condition can be seen in FIG. 10 wherein the drive levers 124, 125 and the frame part 122 were omitted for the sake of simplicity. Thereupon the coupling sleeve 154 and the pipe end 155 have been swaged to completion.

Figure 3:
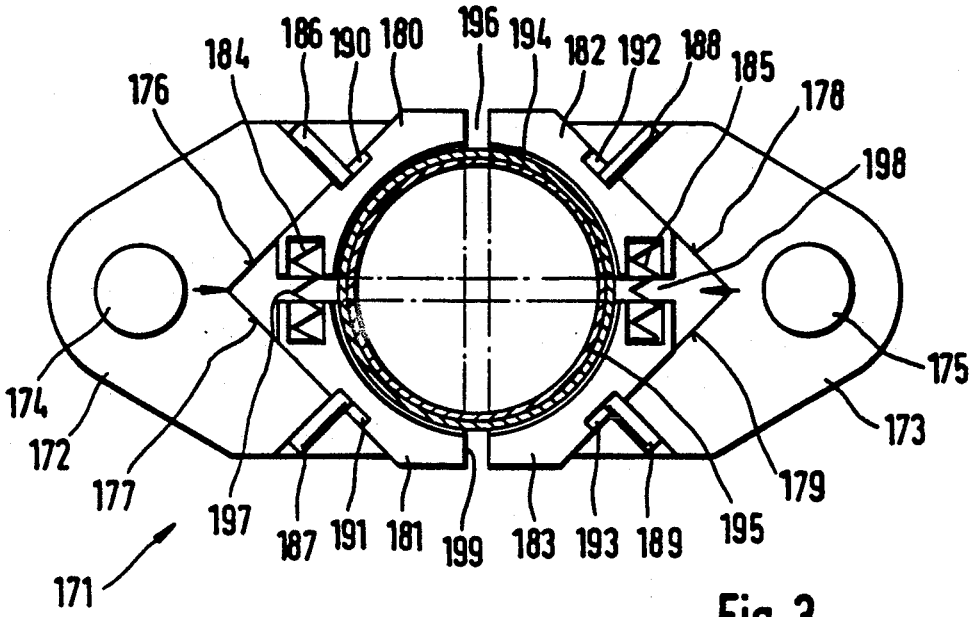
FIG. 3 is part of another compression tool in the open position.
Figure 4:
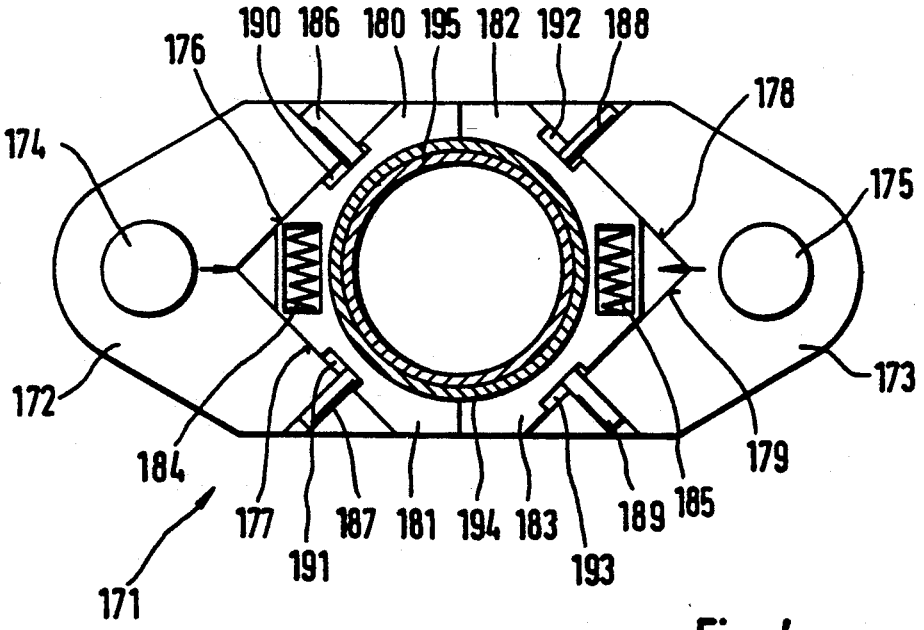
FIG. 4 is the compression tool of FIG. 3 in the closed position.

FIGS. 3 and 4 show a modification of the compression tool 121 of FIGS. 1 and 2, the sole substantial difference being merely four compression jaws instead of six.

The drive means, the tool housing and the drive levers are omitted from the representation of this compression tool 171. The Figures show two compression-jaws supports 172, 173 which are mutually displaceable in identical manner as in the embodiment of FIGS. 9 and 10. They are linked by pivot bolts 174, 175 to omitted drive levers. They comprise V-shaped guide surfaces 176, 177, 178, 179 against which rest compression jaws 180, 181, 182, 183, in each case tow compression jaws 180, 181 and 182, 183 for the compression-jaws supports 172, 173 resp. In each case there is a compression spring 184, 185 between the two compression jaws 180, 181, 182, 183 of each compression-jaws support 172, 173 which provide the bias to force apart, that is outward, the compression jaws 180, 181, 182, 183. The range of motion of the compression jaws 180, 181, 182, 183 is limited by the limit pins 186, 187, 188, 189 projecting above the guide surfaces 176, 177, 178, 179 and engaging clearances 190, 191, 192, 193 in the back sides of the compression jaws 180, 181, 182, 183. The limit pins 186, 187, 188, 189 are mounted in such a way and the clearances 190, 191, 192, 193 are so sized that equally sized gaps 196, 197, 198, 199 will form between the end faces of the compression jaws 180, 181, 182, 183 when abutting a coupling sleeve slipped over one pipe end 195.

Moreover the compression procedure takes place just as it does with compression tool 121 of FIGS. 9 and 10. The compression-jaws supports 172, 173 are displaced toward each other, and in the process the compression jaws 180, 181, 182, 183 on the guide surfaces 176, 177, 178, 179 move inward until their end faces come to rest. This condition is shown in FIG. 12.

I claim:

1. A compression tool, comprising:

a) first and second adjacently disposed pivot levers;

b) first and second jaw supports, each support pivotally connected to one of said levers and pivotal relative thereto for being displaced relative to the other pivot lever and to an axis centrally disposed relative to said supports and said axis extending generally perpendicular to the direction of movement of said supports;

c) a plurality of moveable compression jaws, at least two moveable jaws operably associated with each support and the jaws of one support being uniformly spaced relative to the jaws of the other support;

d) first and second guide means operably associated with each of said supports, one of said guide means of each support oriented in a first direction and the other of said guide means of each support oriented in an opposite direction so that the guide means of each support subtend an angle symmetrical with said axis and opening thereto;

e) each of said jaws operably associated with one of said guide means and moveable relative thereto as said supports are displaced by said pivot levers;

f) each of said guide mans is bounded by a first and a second terminal end portion of the associated jaw support, and each of said terminating second end portions extends outwardly from the associated guide means for thereby providing a stop for the associated jaw.

2. The tool of claim 1, wherein:

a) each of said jaws is of a uniform length.

3. The tool of claim 1, further comprising:

a) a fixed compression jaw operably associated with each of said jaw supports and disposed between the movable jaws thereof.

4. The tool of claim 1, wherein:

a) biasing means are operably associated with each of said jaws for urging said jaws along said guide means, and said biasing means extend parallel to the associated guide means.

5. The tool of claim 4, wherein:

a) each of said biasing means being operably associated with one of said first terminal end portions of urging the associated jaw toward the associated second terminal end portion.

6. The tool of claim 5, wherein:

a) said second terminal end portions of each jaw support extend in parallel.

7. The tool of claim 5, wherein:

a) each biasing means of each jaw of a jaw support is adjacent the biasing means of the associated jaw of the jaw support.

8. The tool of claim 6, wherein:

a) the biasing means of each jaw of a jaw support is adjacent the biasing means of the associated jaw of the jaw support.

9. The tool of claim 1, wherein:

a) the guide means of each jaw support are straight V-shaped guide tracks.

10. The tool of claim 1, wherein:

a) a frame member extends between and is pivotally secured to each of said pivot levers.

11. The tool of claim 3, wherein:

a) a pivot bolt pivotally connects each of said jaw supports to the associated pivot lever; and b) each of said fixed jaws is adjacent the associated pivot bolt.

12. The tool of claim 11, wherein:

a) each of said jaws has an arcuate compression surface, said compression surfaces forming a circle when said jaw supports have been moved toward each other.

13. A compression tool, comprising:

a) first and second adjacently disposed jaw supports, each support having upper and lower guide surfaces and the upper guide surface of each support opening toward the lower guide surface of the opposite support;

b) pivot lever means operably associated with said supports for moving said supports relative to each other and to an axis disposed centrally between said supports and extending transverse to the direction of movement of said supports;

c) each guide surface disposed at an angle to said axis, one guide surface of each support oriented in a first direction and the other guide surface thereof oriented in an opposite direction so that all guide surfaces are directed toward said axis;

d) a plurality of moveable compression jaws, each moveable jaw operably associated with one of said supports and having a jaw surface moveable along an associated guide surface and each said jaw surface being bounded by the associated support so that each jaw moves radially relative to said axis and to the associated guide surface as the associated support is moved;

e) each guide means is straight and is bounded at one terminal end by a stop and at an opposite end by a biasing means urging the associated jaw toward the stop.

14. The tool of claim 13, wherein:

a) each biasing means is a compression spring.

15. The tool of claim 14, wherein:

a) each compression spring extends parallel to the associated guide means.

16. The tool of claim 13, wherein:

a) the biasing means of each guide means of a jaw support is adjacent the biasing means of the associated guide means of the jaw support.

17. The tool of claim 13, wherein:

a) a fixed jaw is operably associated with each support and disposed between the moveable jaws thereof.

18. The tool of claim 13, further comprising:

a) said pivot lever means includes first and second pivot levers, each pivot lever pivotally connected to one of said jaw supports.

19. The tool of claim 18, wherein:

a) a frame member extends between and is pivotally connected to each of said pivot levers.

20. The tool of claim 13, wherein:

a) each of said jaws has an arcuate compression surface, and said compression surfaces forming a circle when said jaw supports are moved toward each other.

* * * * *